United States Patent [19]

Wake

[11] 4,102,139

[45] Jul. 25, 1978

[54] MINING EQUIPMENT

[75] Inventor: Malcolm Wake, Wakefield, England

[73] Assignee: Fletcher Sutcliffe Wild Limited, England

[21] Appl. No.: 688,938

[22] Filed: May 21, 1976

[30] Foreign Application Priority Data

May 22, 1975 [GB] United Kingdom ..... 22142/75
May 22, 1975 [GB] United Kingdom ..... 22140/74

[51] Int. Cl.[2] ..... E21D 15/44
[52] U.S. Cl. ..... 61/45 D
[58] Field of Search ..... 61/45 D; 299/31-33; 248/357; 91/170 MP

[56] References Cited

U.S. PATENT DOCUMENTS

| | | | |
|---|---|---|---|
| 2,910,282 | 10/1959 | Barrett | 61/45 D |
| 3,482,878 | 12/1969 | Floter | 61/45 D X |
| 3,640,581 | 2/1972 | Rassmann et al. | 299/32 |
| 3,811,288 | 5/1974 | Wehner et al. | 61/45 D |
| 3,915,500 | 10/1975 | Schusener et al. | 299/32 |
| 3,952,525 | 4/1976 | Walker et al. | 61/45 D |

FOREIGN PATENT DOCUMENTS

| | | | |
|---|---|---|---|
| 1,332,192 | 6/1963 | France | 61/45 D |
| 1,583,087 | 10/1970 | Fed. Rep. of Germany | 61/45 D |
| 2,024,707 | 12/1971 | Fed. Rep. of Germany | 61/45 D |
| 2,025,138 | 2/1971 | Fed. Rep. of Germany | 61/45 D |
| 1,954,836 | 5/1971 | Fed. Rep. of Germany | 299/32 |
| 1,290,507 | 3/1969 | Fed. Rep. of Germany | 299/32 |

*Primary Examiner*—Dennis L. Taylor
*Attorney, Agent, or Firm*—Lowe, King, Price & Markva

[57] ABSTRACT

A self-advancing, hydraulically powered, mine roof support comprises at least one advancing piston and cylinder unit located in or adjacent a base means of the support and attached at or towards the front of the roof support to a lifting ram operable along an axis normal to the general plane of the base means.

16 Claims, 3 Drawing Figures

1
2
4
5
8
9
10
11
12
13
14
15
16
17
18
19
20
21
22
23
24
25

MINING EQUIPMENT

This invention relates to mining equipment and in particular to self-advancing, hydraulically powered, mine roof supports that are employed along the mineral face and attached, usually via a relay bar, by at least one double acting "advancing" piston and cylinder unit, to the goaf side — and in particular to the clevis rail of the spill plate attached to the goaf side — of an armoured faced conveyor.

The usual arrangement is for the conveyor to be snaked forward, after passage of mineral mining machine, by actuation of the one or more piston and cylinder units, to advance the conveyor, or at least one of the individual pans making up the conveyor, towards the newly exposed mineral face. After the conveyor pans have been so advanced, one by one, the supports themselves are advanced, after being retracted from the mine roof, by the one or more piston and cylinder units being actuated in the reverse direction, so that the roof support pulls on the conveyor to pull itself forward, the conveyor being staked in position inter alia by its connection to adjacent roof supports.

The ease by which the mass of a roof support may be so advanced, depends to a large extent to the prevailing floor conditions, which may contain humps or swillies, or which may be a relatively soft floor. In adverse conditions with floor humps and/or relatively soft floors, advance of the roof support as a whole can be obstructed because of contact between a hump, or a lip in the case of a soft floor, with one or more piston and cylinder units and/or the base of the roof support.

The object of the present invention is to provide a mine roof support in which the advance of a roof support over such humps or lips presents no problems.

According to a first feature of the present invention a self-advancing, hydraulically powered, mine roof support comprises at least one advancing piston and cylinder unit located in or adjacent a base means of the support and attached at or towards the front of the roof support to a lifting ram operable along an axis normal to the general plane of the base means.

Thus when the advancing piston and cylinder unit(s) meets a hump or lip, the ram may be actuated to lift the unit further into the base means and away from the mine floor, to clear of the hump or lip (within the limits imposed on such movement by the clearance of the advancing piston and cylinder unit(s) within the base member of the stroke of the lifting ram)and of course with the base means located on a horizontal floor, the lifting ram operates along a generally vertical axis. Preferably the piston of the advancing unit is located at or towards the front of the roof support.

The attachment of the lifting ram to the advancing unit may be the only connection between the latter and the roof support, for the rear end of the unit may be slidably located within the base means.

Conveniently one or more arms are attached to the cylinder of the or each advancing unit, to project forwardly of the roof support to be attached to the usual clevis rail of the conveyor, preferably via a relay bar.

According to a further feature of the present invention the roof support comprises a relay bar rigidly attached to the piston and cylinder unit and so located with respect to the base means as to be operable on by the lifting ram.

Thus, with the relay bar attached as usual in use to the clevis rail of an armoured conveyor, the ram may be actuated to lift the front of the roof support clear of the mine floor, for ease of advance, the reaction of the lifting ram being taken by the clevis rail via the relay bar. But furthermore, by operating the lifting ram in the reverse direction, the goaf side of the conveyor is lifted via the clevis rail, the reaction of the lifting ram being taken by the roof support, so that the face side of the conveyor is forced towards the mine floor which ensures that the conveyor does not ride up over cut mineral lying on the mine floor, but rather such mineral is loaded on to the conveyor whilst advance of the latter is eased.

To achieve such lifting of roof support and conveyor, the lifting ram may be double acting alternatively, the annulus side of the lifting ram may be permanently pressurized, and the extension and retraction of its piston controlled by admission or exhaust of pressure fluid to the full bore side of the lifting ram.

The attachment of the lifting ram to the advancing unit may be via a pin joint or a ball joint, and likewise for the attachment of the lifting ram to the roof support. This provides some play for lateral movement of the conveyor, and in reality the individual pans thereof, with respect to the roof support, when the conveyor is being snaked forward.

It is preferred with this double lifting feature, for the piston rod of the advancing unit to be located at or towards the front of the support, so that the more robust cylinder may form the attachment point for the rear end of the relay bar. Such attachment may be by a clamping sleeve surrounding the forward end of the cylinder and secured by one or more bolts, or alternatively, the rear end of the relay bar could be welded to the cylinder. In detail, the relay bar may extend underneath the piston rod of the advancing unit and may be approximately the same length as the piston rod and be rigidly attached to the front end of the cylinder. The rear end of the latter may carry lateral projections at each side to engage slidably support ribs extending in the direction of advance of the advancing unit and hence in the direction of advance of the support, over a distance corresponding to the maximum stroke of the advancing unit.

The invention will now be further described, by way of example, with reference to the accompanying drawings, in which.

Figures 1, 2:
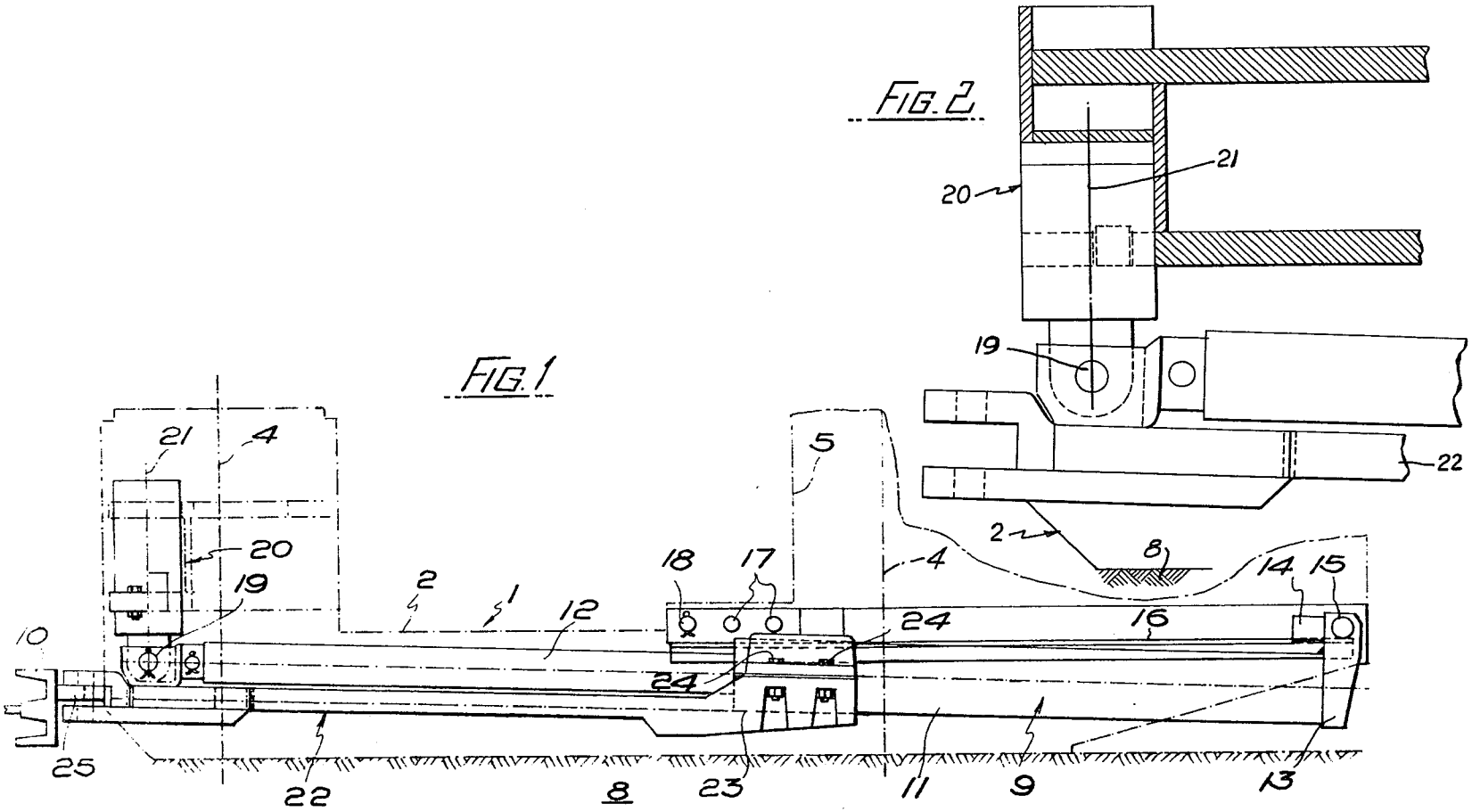
FIG. 1 is a side elevation of the lower portion of a roof support in accordance with the invention.
FIG. 2 is a sectional view of a portion of FIG. 1, showing further details.
Figure 3:
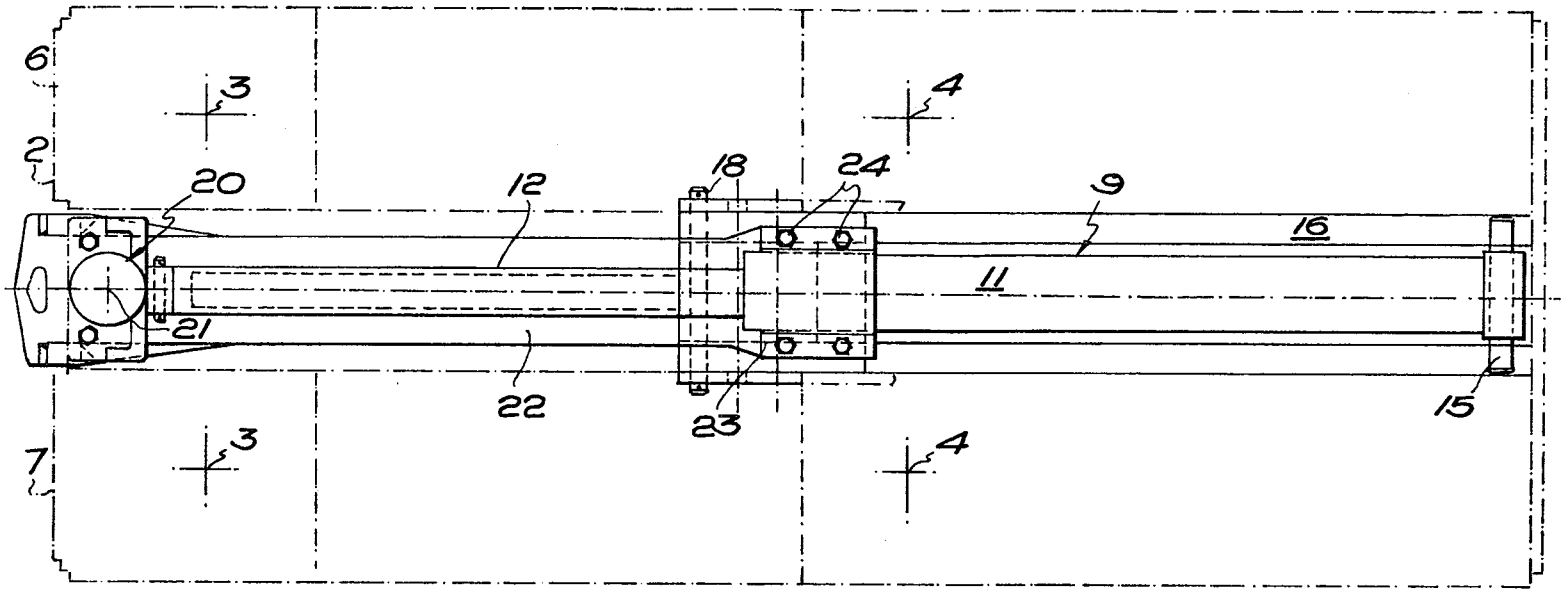
FIG. 3 is a plan view of FIG. 1.

In the drawings, a mine roof support 1 comprises a base means 2 indicated in chain-dotted line and a plurality of hydraulically extensible chock legs (not shown), longitudinal axis of a pair of forward chock legs being indicated at 3 and a pair of rearward chocks legs at 4, while a shield to prevent ingress into the support 1 of goaf side dirt and rock is indicated at 5.

The base means 2 comprises two spaced, parallel side members 6 and 7 which seat on a mine floor indicated at 8 and on each of which is mounted a forward and a rearward chock leg and between the side members 6, 7 is located a double-acting hydraulic piston and cylinder unit 9 adapted, in known manner to advance the conveyor indicated at 10, when the roof support is staked in roof supporting position by extension of the chock legs, and also to advance the support to the advanced conveyor upon release of the support from roof supporting and engaging position. The unit 9 comprises a cylinder 11 and a piston rod 12, the cylinder 11 being provided at its closure cap 13 with an engagement finger 14 and lateral projections constituted by a transverse support pin 15, together forming generally a T-shape, the engagement finger 14 passing through a longitudinal slot in the base means 2 so that an underside of the pin 15 may bear on a slide surface 16 of the base means, so as to suspend the cylinder therefrom, clear of the mine floor 8. The base means 2 is provided, between the forward and rearward chock legs with a plurality of spaced abutment holes 17 extending laterally of the longitudinal axis of the piston and cylinder unit 9 into a selected one of which holes a stop pin 18 is insertable to define one of a plurality of abutment positions. The piston rod 12 attached at or towards the front of the roof support 1 by being anchored to the base means 2 via a pin 19 carried by a lift ram 20, operable along an axis 21 normal to the general plane of the base means 2. A relay bar 22 is rigidly attached at its rear end 23 by bolts 24 to the front end of the cylinder 11 by a bolt (not shown) to the usual clevis rail 25 of a trough section of a conveyor 10, the relay bar 22 extending underneath the piston rod and being of approximately the same length as the latter.

After passage along the conveyor 10, in a mineral cutting of a mining device, the conveyor 10 needs to be advanced from the position shown in FIG. 1, towards the newly exposed mineral face e.g. by 30 inches if the mining device is removing 30 inches webs of mineral with the chock legs remaining extended, pressurised fluid is admitted to the annulus side of the piston and cylinder unit 9 to begin retraction of the piston rod 12 into the cylinder 11, but with the rod 12 anchored on the pin 19, the cylinder 11 advances and hence the integral relay bar 21 to push forward the trough section of the conveyor 10 to which the relay bar 22 is attached. Should the cylinder 11 and/or relay bar 22 meet an obstruction e.g. a hump or a lip, in the mine floor 8, retraction of the lift ram 20 from a partially extended position lifts the piston and cylinder unit 9 so as to clear the cylinder 11 and/or relay bar 22 of the obstruction. Furthermore, this has the effect of lifting the goaf side of the conveyor 10 which aids loading of cut mineral onto the conveyor at the face side thereof. Also during this advance, the underside of the support pin 15 slides along the surface 16 until the engagemment finger 14 strikes the stop pin 18 which has been inserted into a hole 17 so as to determine the maximum advance of the conveyor trough section, as described in co-pending Application No. 22139/75. When it is required to advance the support 1 to the advance conveyor, to attain again the relative positions between the conveyor and support shown in FIG. 1, pressure fluid is supplied to the full bore side of the piston and cylinder unit 9 to extend the latter, the support pin 15 sliding rearwardly, after release of the chock legs from the mine roof. Should the front end of the base means 2 meet a floor obstruction during such advance, then extension of the lift ram 20 reacts on the relay bar and clevis rail to lift the front end of the base means clear of the obstruction.

What we claim is:

1. A self-advancing, hydraulically powered mine roof support apparatus comprising a roof support means; a base means for supporting said roof support means on a mine floor; at least one advancing piston and cylinder unit pivotally carried by said base means; a relay bar having first and second ends, said first end being rigidly connected to said advancing unit, said second, free end adapted to be attached to a mine face conveyor; and a lifting ram connected between said roof support means and said relay bar in proximity to a forward end of said mine roof support means, said lifting ram being operative to lift one of said advancing unit and the forward end of said base means to avoid obstructions located on the mine floor.

2. A roof support as in claim 1, wherein the lifting ram operates along a generally vertical axis.

3. A roof support as in claim 1, wherein the piston of the advancing unit is located at or towards the front of the roof support.

4. A roof support as in claim 1, wherein the attachment of the lifting ram to the advancing unit is the only connection between the latter and the roof support.

5. A roof support as in claim 1, wherein the rear end of the unit is slidably located within the base means.

6. A roof support as in claim 1, wherein one or more arms are attached to the cylinder of the or each advancing unit, to project forwardly of the roof support to be attached to the usual clevis rail of the conveyor.

7. A roof support as in claim 6, wherein the arms are attached to the clevis rail by a relay bar.

8. A roof support as in claim 1, wherein the lifting ram is double acting.

9. A roof support as in claim 1, wherein the annulus side of the lifting ram is permanently pressurized, and extension and retraction of its piston are controlled by admission or exhaust of pressure fluid to the full bore side of the lifting ram.

10. A roof support as in claim 1, wherein the attachment of the lifting ram to the advancing unit is via a pin joint or ball joint, and likewise is the attachment of the lifting ram to the roof support.

11. A roof support as in claim 1, wherein the piston rod of the advancing unit is located at or towards the front of the support, so that the more robust cylinder may form the attachment point for the rear end of the relay bar.

12. A roof support as in claim 11, wherein such attachment is by a clamping sleeve surrounding the forward end of the cylinder and secured by one or more bolts.

13. A roof support as in claim 11, wherein such attachment is provided by the rear end of the relay bar being welded to the cylinder.

14. A roof support as in claim 1, wherein the relay bar extends underneath the piston rod of the advancing unit.

15. A roof support as in claim 1, wherein the relay bar is approximately the same length as the piston rod and rigidly attached to the front end of the cylinder.

16. A roof support as in claim 1, wherein the rear end of the cylinder carries lateral projections at each side to engage slidably support ribs extending in the direction of advance of the advancing unit and hence in the direction of the advance of the support, over a distance corresponding to the maximum stroke of the advancing unit.

* * * * *